US010329967B2

(12) United States Patent
Camilo et al.

(10) Patent No.: US 10,329,967 B2
(45) Date of Patent: Jun. 25, 2019

(54) PHASER OIL RESERVOIR ON LOCKING COVER SURFACE

(71) Applicant: Schaeffler Technologies AG & Co. KG, Herzogenaurach (DE)

(72) Inventors: Alexandre Camilo, Rochester Hills, MI (US); Kevin Poole, Northville, MI (US); Renato de Oliveria Ghiraldi, Madison Heights, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 171 days.

(21) Appl. No.: 15/458,168

(22) Filed: Mar. 14, 2017

(65) Prior Publication Data

US 2018/0266284 A1 Sep. 20, 2018

(51) Int. Cl.
*F01L 1/34* (2006.01)
*F01L 1/344* (2006.01)

(52) U.S. Cl.
CPC ... *F01L 1/3442* (2013.01); *F01L 2001/34446* (2013.01); *F01L 2001/34469* (2013.01)

(58) Field of Classification Search
CPC ..... F01L 1/3442; F01L 2001/34446; F01L 2001/34469
See application file for complete search history.

(56) References Cited

U.S. PATENT DOCUMENTS 5,836,276 A * 11/1998 Iwasaki ..... F01L 1/3442 123/90.17
6,386,167 B1 5/2002 Urckfitz et al.

* cited by examiner

*Primary Examiner* — Zelalem Eshete
(74) *Attorney, Agent, or Firm* — Matthew V. Evans

(57) ABSTRACT

An oil reservoir for a variable camshaft phaser, comprising a locking cover including a front surface including a pool, the pool having a plurality of through-bores, a rear surface including a locking pin channel, a radially inward facing surface, and a radially outward facing surface, and an oil reservoir cover secured to the front surface of the locking cover.

20 Claims, 7 Drawing Sheets

PHASER OIL RESERVOIR ON LOCKING COVER SURFACE

FIELD

The present disclosure relates to an oil reservoir for a variable camshaft phaser, in particular, a locking cover with a recess for minimizing the total required axial space of the oil reservoir.

BACKGROUND

A variable camshaft phaser (VCP) is an internal combustion engine component that controls the timing of the valve lift event. The combustion process can be improved when the engine timing is properly varied. The benefits from properly varied engine timing include increased engine efficiency, improved idle stability, torque/potency enhancement, increased fuel economy, and reduced hydrocarbon emissions. Hydraulic VCPs operate utilizing oil pressure (in a closed chamber) and torsionals (kinetic energy) provided by the cams. In general, VCPs comprise a driven element, covers, and a driver element, which is connected to the camshaft in some way. An oil control valve (OCV) is used to control the oil flow supplied by the engine oil pump, via the main oil reservoir, to the VCP inner chambers. When the VCP is full and the proper pressure is established inside, the driver element (i.e., rotor) rotates. This is called camshaft phasing.

SUMMARY

According to aspects illustrated herein, there is provided an oil reservoir for a variable camshaft phaser, comprising a locking cover, including a front surface including a pool, the pool having a plurality of through-bores, a rear surface including a locking pin channel, a radially inward facing surface, and a radially outward facing surface, and an oil reservoir cover secured to the front surface of the locking cover.

According to aspects illustrated herein, there is provided an oil reservoir for a variable camshaft phaser, comprising a locking cover, including a front surface including a pool, the pool having a plurality of through-bores, a rear surface including a locking pin channel, a radially inward facing surface including a recess extending radially outward therefrom, and a radially outward facing surface, and an oil reservoir cover secured to the front surface of the locking cover.

According to aspects illustrated herein, there is provided an oil reservoir for a variable camshaft phaser, comprising a locking cover, including a front surface including a pool having a plurality of through-bores, a first plurality of holes operatively arranged to attach the locking cover to the variable camshaft phaser using a plurality of bolts, a rear surface including a locking pin channel, a radially inward facing surface including a recess extending radially outward therefrom, and a radially outward facing surface, and an oil reservoir cover secured to the front surface of the locking cover.

It therefore is an object of the disclosure to provide an oil reservoir requiring minimal axial space.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

Figure 1:
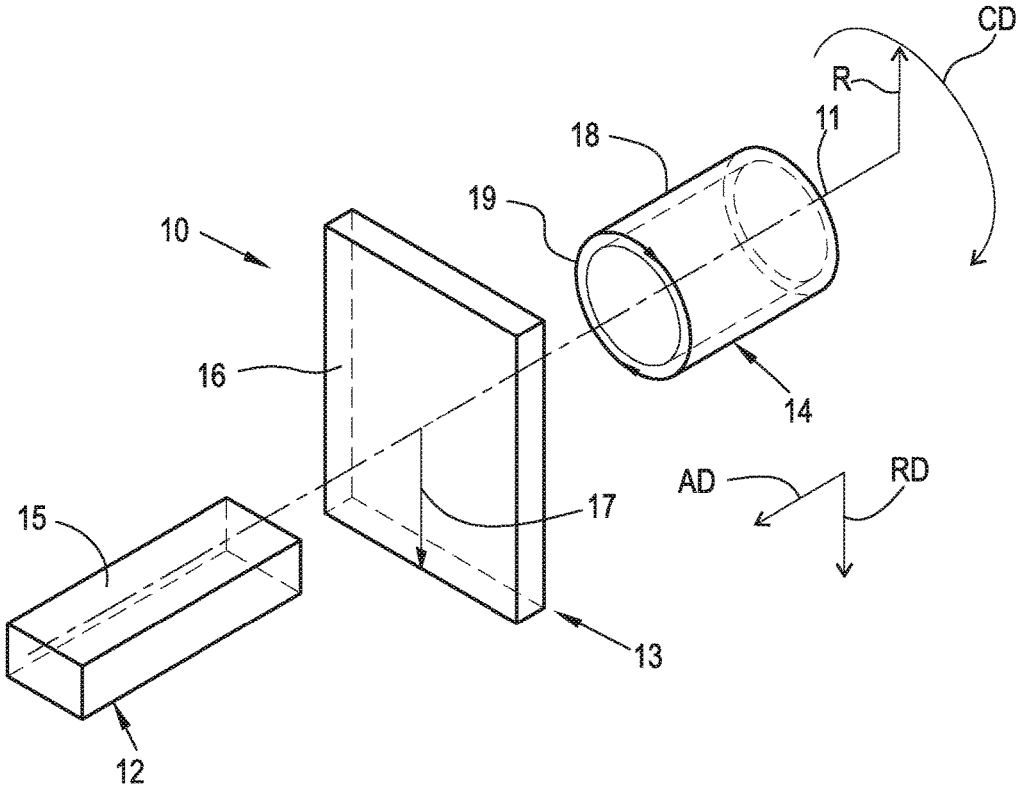
FIG. 1 is a perspective view of a cylindrical coordinate system demonstrating spatial terminology used in the present application.

Adverting now to the figures, FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
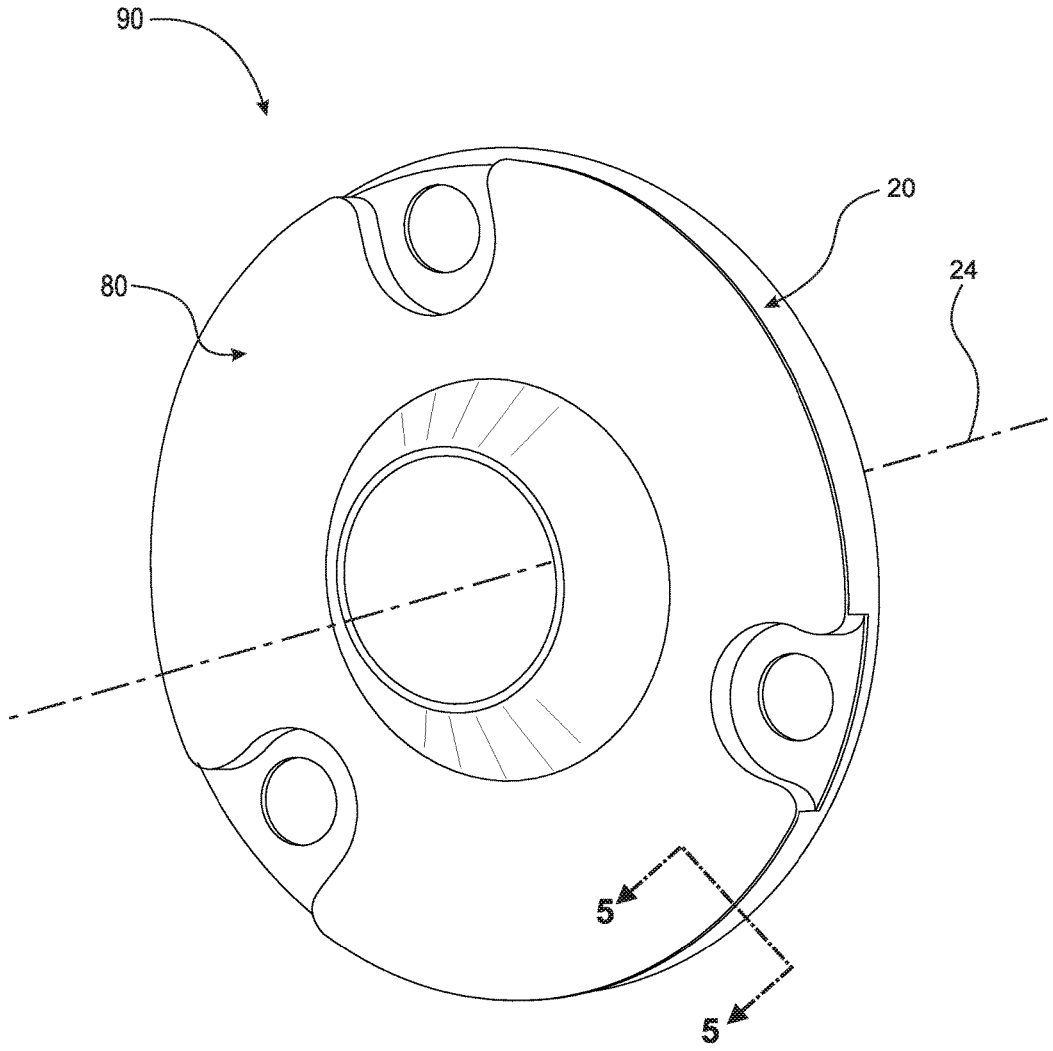
FIG. 2 is a front perspective view of an oil reservoir.
Figure 3:
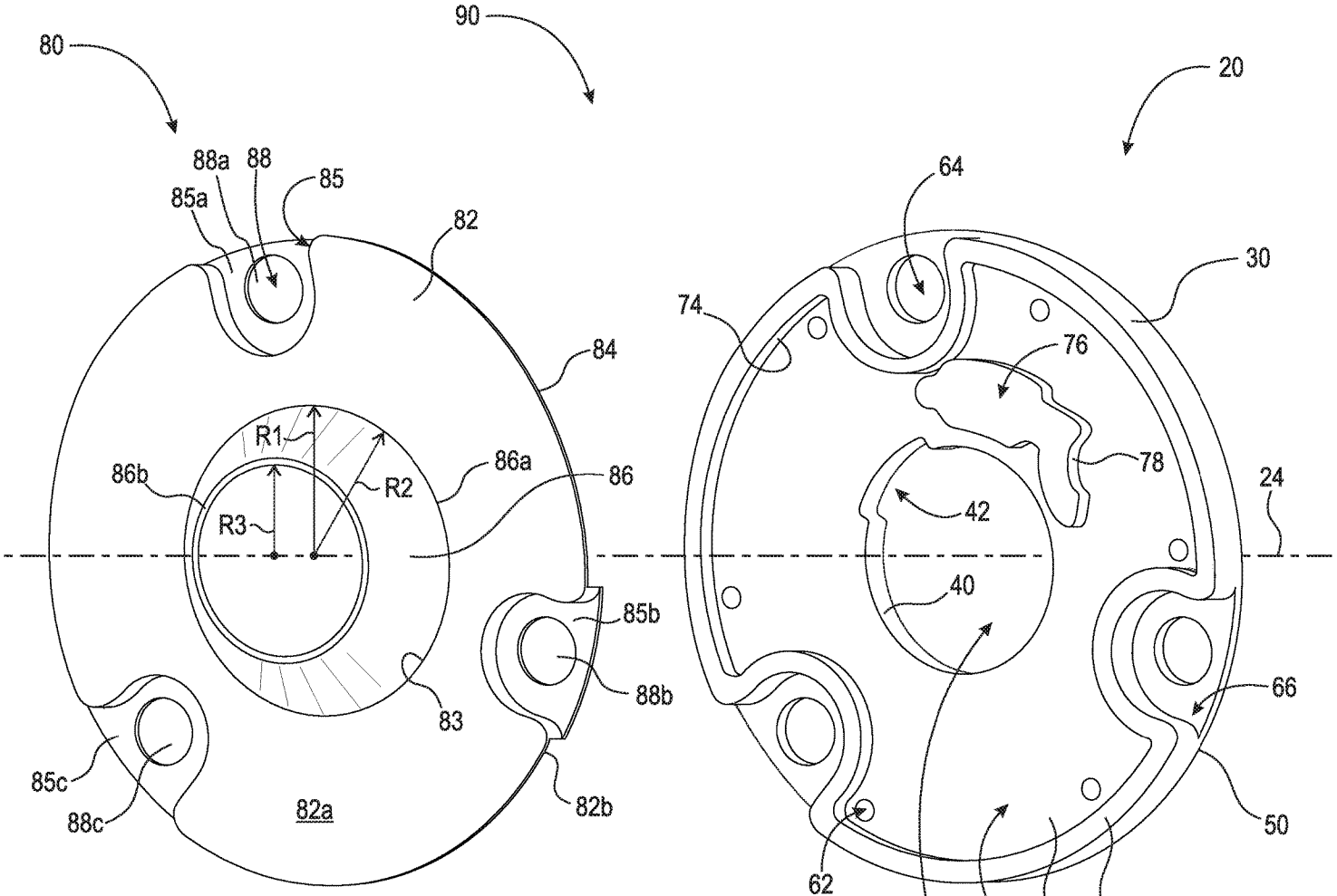
FIG. 3 is an exploded perspective view of the oil reservoir shown in FIG. 2.

FIG. 2 is a front perspective view of oil reservoir 90. FIG. 3 is an exploded perspective view of oil reservoir 90. Oil reservoir 90 generally comprises camshaft phaser locking cover 20 and oil reservoir cover 80. Bolts 120 secure oil reservoir cover 80 and locking cover 20 to variable camshaft phaser 100 (shown in FIG. 6). Oil reservoir cover 80 is a circular plate comprising radial surface 82 and frusto-conical surface 86. For the purposes of this description, oil reservoir cover 80 is arranged concentrically about axis of rotation 24. Radial surface 82 is an annular ring comprising front surface 82*a*, rear surface 82*b*, radially inward facing edge 83, radially outward facing edge 84, and a plurality of depressions 85. Radially inward facing edge 83 is circular and comprises radius R1. Frusto-conical surface 86 is generally a cone with the narrow end, or tip, removed and comprises proximate edge 86*a* and distal edge 86*b*. Proximate edge 86*a* is circular and comprises radius R2, equal to radius R1. Distal edge 86*b* is circular and comprises radius R3, less than radius R2. Proximate edge 86*a* is secured to radially inward facing edge 83. In an example embodiment, oil reservoir cover 80 is formed from thin sheet metal by a suitable manufacturing means, i.e., machined, formed, stamped. It should be appreciated, however, that oil reservoir cover 80 can be formed from any other material suitable to secure to locking cover 20 and create a reservoir for oil capture with minimal axial and radial dimensions.

Depressions 85 are sunken areas in front surface 82*a* arranged circumferentially thereon and proximate radially outward facing edge 84. Cover bolts holes 88 are arranged in each of depressions 85. Depressions 85 are operatively arranged to align and engage with counter-bores 66. Cover bolts holes 88 are operatively arranged to align with cover bolts holes 64. In an example embodiment, as shown in FIG. 3, oil reservoir cover 80 comprises depressions 85*a*, 85*b*, and 85*c*, and cover bolts holes 88*a*, 88*b*, and 88*c*, arranged about axis of rotation 24 at approximately 100°, 340°, and 220°, respectively. It should be appreciated, however, that any number of cover bolts holes in any arrangement suitable for securing oil reservoir cover 80 and camshaft phaser cover 20 to variable camshaft phaser 100 may be used (see example in FIG. 6). It should also be appreciated, that any suitable means for securing oil reservoir cover 80 and camshaft phaser cover 20 to variable camshaft phaser 100 may be used, e.g., rivets, and that the present disclosure is not limited to using bolts as a securement method.

Figure 4B:
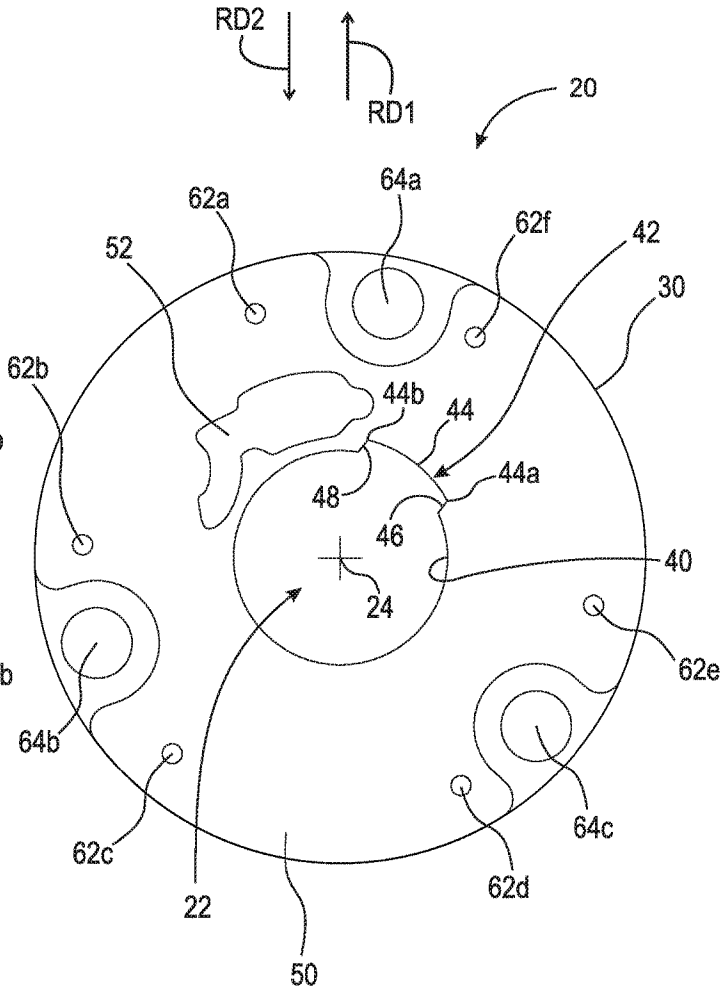
FIG. 4B is a rear planar view of the locking cover shown in FIG. 3.
Figure 4A:
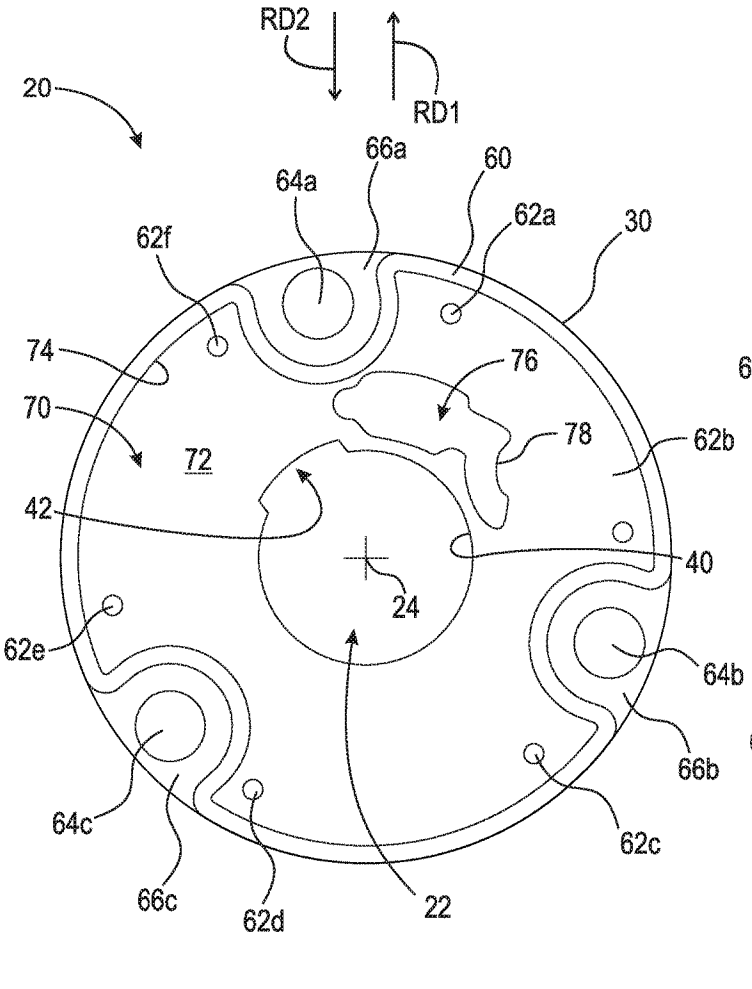
FIG. 4A is a front planar view of the locking cover shown in FIG. 3.

FIGS. 4A and 4B are front and rear planar views of locking cover 20, respectively. The following description should be viewed in light of FIGS. 3, 4A, and 4B.

Camshaft phaser locking cover 20 is a circular plate comprising center through-bore 22, radially outward facing surface 30, radially inward facing surface 40, rear surface 50, and front surface 60. For the purposes of this description, locking cover 20 is arranged concentrically about axis of rotation 24.

Radially outward facing surface 30 and radially inward facing surface 40 are circumferential surfaces extending axially from front surface 60 to rear surface 50. Radially inward facing surface 40 comprises recess 42 arranged circumferentially thereon. Recess 42 extends radially outward in direction RIM from radially inward facing surface 40. Recess 42 is designed to allow oil to drain from variable camshaft phaser 100, specifically the rotor, so that the locking pin is not prevented from disengaging locking pin channel 52 of cover plate 20. Oil can drain from the locking pin hole (in the rotor), out of variable camshaft phaser 100 through recess 42, and into oil reservoir 90. In an example embodiment, recess 42 comprises surface 44, surface 46, and surface 48 (shown in FIG. 4B). Surface 44 is a substantially circumferential surface arranged at least partially concentric to radially inward facing surface 40. In an example embodiment, surface 44 is arcuate and comprises end 44*a* and end 44*b*. Surfaces 46 and 48 are substantially axial surfaces. Surface 46 is at least partially planar and extends generally in radial direction RD1 from radially inward facing surface 40 to end 44*a*. Surface 48 is at least partially planar and extends generally in radial direction RD1 from radially inward facing surface 40 to end 44*b*. It should be appreciated, however, that recess 42 may comprise any other design suitable for allowing oil to drain from the rotor locking pin hole of variable camshaft phaser 100.

Rear surface 50 is a substantially planar radial surface directed toward variable camshaft phaser 100 during assembly. Rear surface 50 comprises locking pin channel 52. Locking pin channel 52 is a groove in rear surface 50 operatively arranged to receive the locking pin of variable camshaft phaser 100. When locking cover 20 is secured to variable camshaft phaser 100, locking pin channel 52 aligns with the locking pin hole of the rotor. To stop or limit phasing, the locking pin is forced out of the locking pin hole by the locking pin spring axially toward locking cover 20. The locking pin engages locking pin channel 52 to non-rotatably connect the rotor with locking cover 20 and the stator (not shown). Rear surface 50 is substantially perpendicular to radially outward facing surface 30 and radially inward facing surface 40. In an example embodiment, rear surface 50 is not perpendicular to radially outward facing surface 30 and/or radially inward facing surface 40.

Front surface 60 is a radial surface comprising pool 70, a plurality of oil holes 62, a plurality of cover bolts holes 64, and a plurality of counter-bores 66. Front surface 60 is substantially perpendicular to radially outward facing surface 30 and radially inward facing surface 40. In an example embodiment, front surface 60 is not perpendicular to radially outward facing surface 30 and/or radially inward facing surface 40.

Pool 70 is a recess formed in the front surface 60 to allow for oil accumulation. Pool 70 comprises bottom surface 72, outer wall 74, and island 76. Bottom surface 72 is generally a radial surface arranged axially between front surface 60 and rear surface 50 (see FIG. 5). In an example embodiment, bottom surface 72 is substantially parallel to front surface 60 and rear surface 50. Outer wall 74 is generally a circumferential surface arranged proximate to radially outward facing surface 30. Outer wall 74 is substantially perpendicular to bottom surface 72 and defines an outer radial boundary of pool 70. Outer wall 74 is the boundary between pool 70 and front surface 60. In an example embodiment, outer wall 74 is not perpendicular to bottom surface 72. Island 76 is the area on front surface 60 that corresponds to locking pin channel 52 (i.e., houses/encases locking pin channel 52). Island 76 comprises island wall 78. Island wall 78 is substantially perpendicular to bottom surface 72 and defines a boundary of pool 70. In an example embodiment, island wall 78 is not perpendicular to bottom surface 72.

Oil holes 62 are through-bores arranged within pool 70 that extend axially from bottom surface 72 to rear surface 50. Oil holes 62 allow oil to pass, or leak, through locking cover 20 between oil reservoir 90 (formed between locking cover 20 and oil reservoir cover 80) and the chambers of variable camshaft phaser 100, during phasing. This leaking of oil in and out of the chambers, known as oil accumulation, improves the adjustment speed of variable camshaft phaser 100 by accelerating the flow of oil into and out of the chambers. In an example embodiment shown in FIGS. 4A and 4B, locking cover 20 comprises oil holes 62*a*, 62*b*, 62*c*, 62*d*, 62*e*, and 62*f* operatively arranged to align with a corresponding advance or retard chamber when locking cover 20 is secured to variable camshaft phaser 100. For example, oil holes 62*a* and 62*b* align with the first advance and first retard chambers, respectively, oil holes 62*c* and 62*d* align with the second advance and second retard chambers, respectively, and oil holes 62*e* and 62*f* align with the third advance and third retard chambers, respectively (not shown). It should be appreciated, however, that any number of oil holes suitable for oil accumulation may be used.

Cover bolts holes 64 are through-bores arranged around locking cover 20 such that locking cover 20 can be secured to variable camshaft phaser 100. In an example embodiment, bolts 120 secure locking cover 20 and oil reservoir 80 to variable camshaft phaser 100 by extending through the stator and engaging back plate 110 (shown in FIG. 6). Cover bolts holes 64 extend axially from front surface 60 to rear surface 50. Counter-bores 66 are arranged in, and at least partially concentric to, each of cover bolts holes 64. Counter-bores 66 are partial through-bores extending axially from front surface 60 toward rear surface 50 and allow the head of each bolt (or fastener) to be flush with, or below the level of, front surface 60. It should be appreciated that, in an example embodiment, counter-bores 66 can instead be recessed portions of front surface 60 that are not concentric to cover bolts holes 64. In an example embodiment, as shown in FIG. 4A, locking cover 20 comprises cover bolts holes 64*a*, 64*b*, and 64*c*, and counter-bores 66*a*, 66*b*, and 66*c*, arranged about axis of rotation 24 at approximately 100°, 340°, and 220°, respectively. In the rear view shown in FIG. 4B, cover bolts holes 64*a*, 64*b*, and 64*c* are shown arranged about axis of rotation 24 at approximately 80°, 200°, and 320°, respectively. It should be appreciated, however, that any number of cover bolts holes in any arrangement suitable for securing camshaft phaser cover 20 to variable camshaft phaser 100 may be used. It should also be appreciated, that any suitable means for securing camshaft phaser cover 20 to variable camshaft phaser 100 may be used, e.g., rivets, and that the present disclosure is not limited to using bolts as a securement method.

Figure 5:
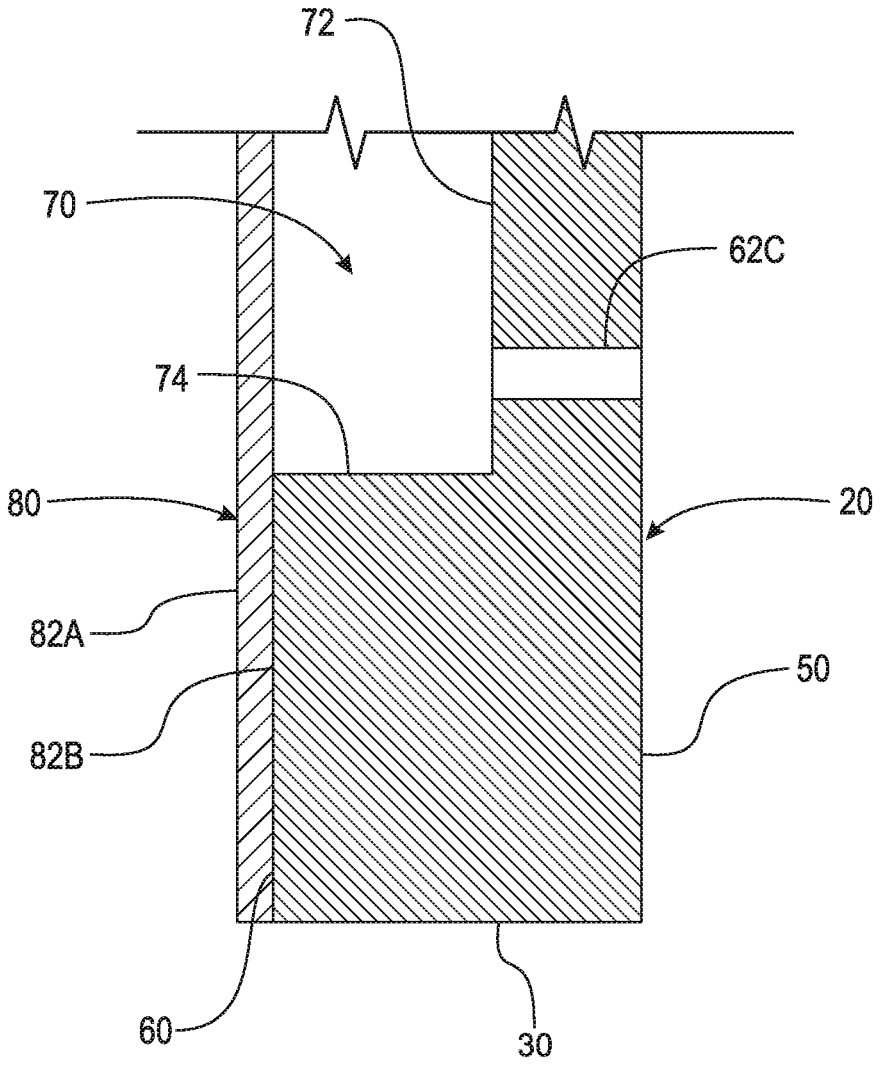
FIG. 5 is a cross-sectional view of the oil reservoir shown in FIG. 2 taken generally along line 5-5.

FIG. 5 is a cross-sectional view of oil reservoir 90 taken generally along line 5-5 in FIG. 2. Oil reservoir 90 is formed when oil reservoir cover 80 is secured to locking cover 20. The volume between oil reservoir cover 80 and locking cover 20 defines the volume of oil reservoir 90. Thus, the volume added to oil reservoir 90 by pool 70 allows the axial distance between oil reservoir cover 80 and front surface 60 of locking cover 20 to be reduced. It is desired that pool 70 have the greatest possible volume to maximize the amount of oil that can accumulate therein. The volume of pool 70 can varied by: changing the depth of pool 70 (i.e., increasing/decreasing the axial distance between front surface 60 and bottom surface 72), changing the outer boundary of pool 70 (i.e., increasing/decreasing the radial distance between outer wall 74 and radially outward facing surface 30), and changing the areal size of island 76.

Figure 6:
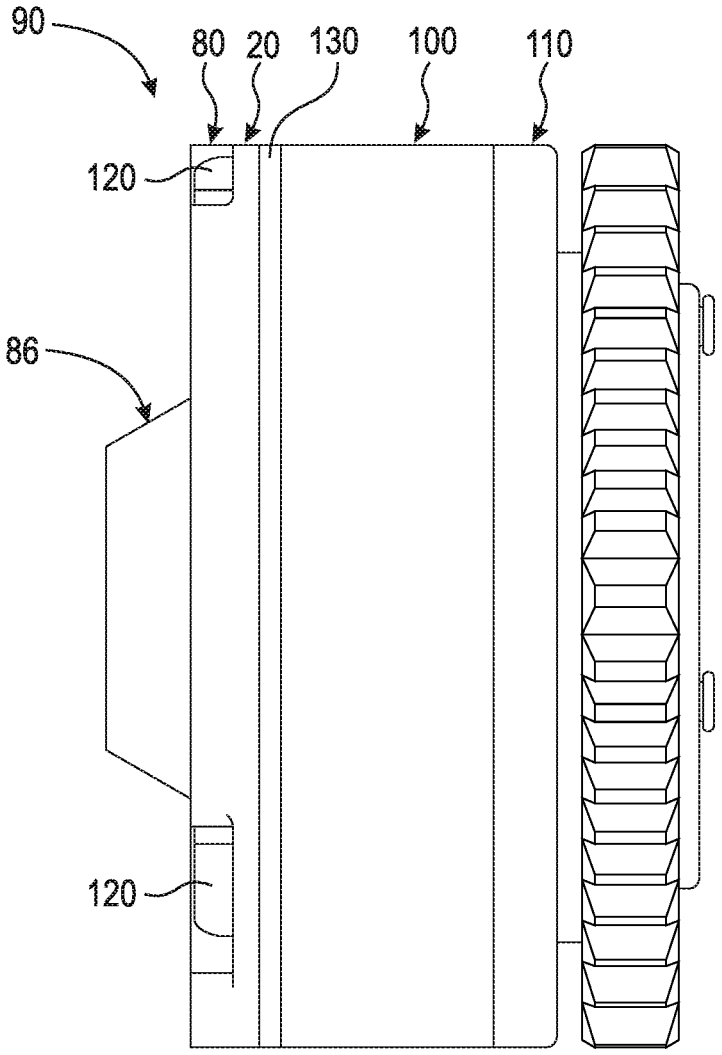
FIG. 6 is a side view of the oil reservoir shown in FIG. 2 assembled on a variable camshaft phaser; and, FIG. 7 is a front perspective view of a check valve plate.

FIG. 6 is a side view of oil reservoir 90 shown in FIG. 2 assembled on variable camshaft phaser 100. Bolts 120 secure locking cover 20 and oil reservoir 80 to variable camshaft phaser 100 by extending through variable camshaft phaser 100 (specifically the stator) and engaging back plate 110. Check valve plate 130 is arranged between locking cover 20 and the stator of variable camshaft phaser 100. Check valve plate 130 regulates the movement of oil through oil holes 62.

Figure 7:
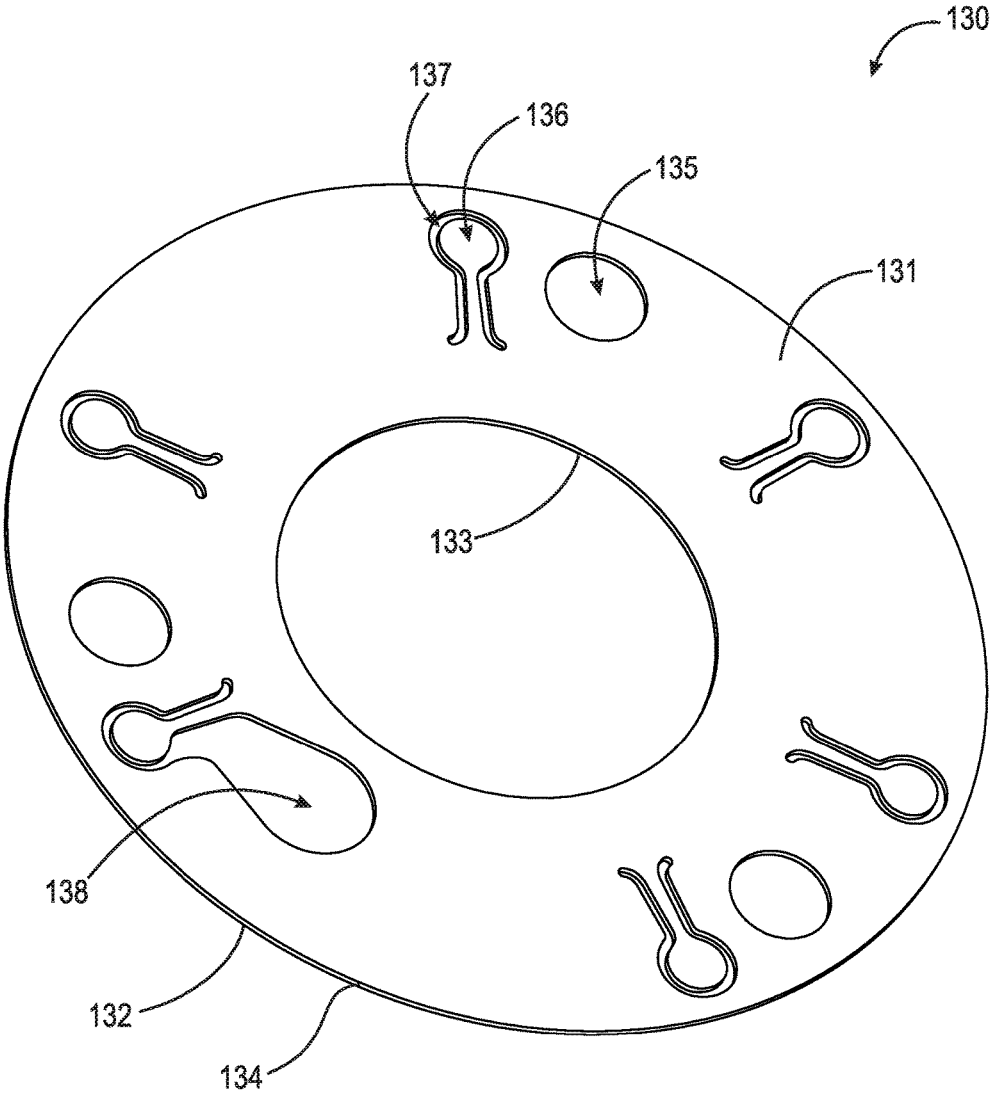

FIG. 7 is a front perspective view of check valve plate 130. Check valve plate 130 is a circular plate comprising front surface 131, rear surface 132, radially inward facing edge 133, and radially outward facing edge 134. Check valve plate 130 further comprises bolts holes 135, flaps 136, gaps 137, and aperture 138. Check valve plate 130 is assembled axially between locking cover 20 and the stator of variable camshaft phaser 100 such that front surface 131 abuts against rear surface 50. Gaps 137 are arranged around flaps 136. In an example embodiment, check valve plate 130 is assembled axially between locking cover 20 and the stator of variable camshaft phaser 100 such that rear surface 132 abuts against rear surface 50. Bolts 120 secure oil reservoir 80, locking cover 20, and check valve plate 130 to variable camshaft phaser 100 by extending through variable camshaft phaser 100 (specifically the stator) and engaging back plate 110. Flaps 136 are arranged to align with oil holes 62. Flaps 136 regulate the movement of oil through oil holes 62.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Cylindrical coordinate system
11 Longitudinal axis
12 Object
13 Object
14 Object
15 Axial surface
16 Radial surface
17 Radius
18 Surface
19 Circumference
20 Camshaft phaser locking cover
22 Center through-bore
24 Axis of Rotation

30 Radially outward facing surface
40 Radially inward facing surface
42 Recess
44 Surface
44*a* End
44*b* End
46 Surface
48 Surface
50 Rear surface
52 Locking pin channel
60 Front surface
62 Oil holes
62*a* Oil hole
62*b* Oil hole
62*c* Oil hole
62*d* Oil hole
62*e* Oil hole
62*f* Oil hole
64 Cover bolts holes
64*a* Cover bolts hole
64*b* Cover bolts hole
64*c* Cover bolts hole
66 Counter-bores
66*a* Counter-bore
66*b* Counter-bore
66*c* Counter-bore
70 Pool
72 Bottom surface
74 Outer wall
76 Island
78 Island wall
80 Oil reservoir cover
82 Radial surface
82*a* Front surface
82*b* Rear surface
83 Radially inward facing edge
84 Radially outward facing edge
85 Depressions
85*a* Depression
85*b* Depression
85*c* Depression
86 Frusto-conical surface
86*a* Proximate edge
86*b* Distal edge
88 Cover bolts holes
88*a* Cover bolts hole
88*b* Cover bolts hole
88*c* Cover bolts hole
90 Oil reservoir
100 Variable camshaft phaser
110 Back plate
120 Bolts
130 Check valve plate
131 Front surface
132 Rear surface
133 Radially inward facing edge
134 Radially outward facing edge
135 Bolts holes
136 Flaps
137 Gaps
138 Aperture
R1 Radius
R2 Radius
R3 Radius

What is claimed is:

1. An oil reservoir for a variable camshaft phaser, comprising:

a locking cover, including:

a front surface including a pool, the pool having a plurality of through-bores;

a rear surface including a locking pin channel;

a radially inward facing surface; and, a radially outward facing surface; and, an oil reservoir cover secured to the front surface of the locking cover.

2. The oil reservoir as recited in claim 1, wherein the locking cover further comprises a recess extending radially outward from the radially inward facing surface.

3. The oil reservoir as recited in claim 1, wherein the locking cover further comprises a first plurality of holes operatively arranged to attach the locking cover to the variable camshaft phaser via a plurality of bolts.

4. The oil reservoir as recited in claim 3, wherein the locking cover further comprises a plurality of counter-bores, and each of the first plurality of holes comprises one of the plurality of counter-bores.

5. The oil reservoir as recited in claim 4, wherein the oil reservoir cover comprises a plurality of depressions extending in a first axial direction, the plurality of depressions operatively arranged to engage the plurality of counter-bores.

6. The oil reservoir as recited in claim 5, wherein the oil reservoir cover further comprises a second plurality of holes operatively arranged to align with the first plurality of holes and attach the oil reservoir cover to the variable camshaft phaser via the plurality of bolts.

7. The oil reservoir as recited in claim 6, wherein the oil reservoir cover comprises a frusto-conical surface extending in a second axial direction, opposite the first axial direction.

8. The oil reservoir as recited in claim 7, wherein the oil reservoir cover is made of thin sheet metal.

9. An oil reservoir for a variable camshaft phaser, comprising:

a locking cover, including:

a front surface including a pool, the pool having a plurality of through-bores;

a rear surface including a locking pin channel;

a radially inward facing surface including a recess extending radially outward therefrom; and, a radially outward facing surface; and, an oil reservoir cover secured to the front surface of the locking cover.

10. The oil reservoir as recited in claim 9, wherein the locking cover further comprises a first plurality of holes operatively arranged to attach the locking cover to the variable camshaft phaser via a plurality of bolts.

11. The oil reservoir as recited in claim 10, wherein the locking cover further comprises a plurality of counter-bores, and each of the first plurality of holes comprises one of the plurality of counter-bores.

12. The oil reservoir as recited in claim 11, wherein the oil reservoir cover comprises a plurality of depressions extending in a first axial direction, the plurality of depressions operatively arranged to engage the plurality of counter-bores.

13. The oil reservoir as recited in claim 12, wherein the oil reservoir cover further comprises a second plurality of holes operatively arranged to align with the first plurality of holes and attach the oil reservoir cover to the variable camshaft phaser via the plurality of bolts.

14. The oil reservoir as recited in claim 13, wherein the oil reservoir cover comprises a frusto-conical surface extending in a second axial direction, opposite the first axial direction.

15. The oil reservoir as recited in claim 14, wherein the oil reservoir cover is made of thin sheet metal.

16. An oil reservoir for a variable camshaft phaser, comprising:

a locking cover, including:

a front surface including:

a pool having a plurality of through-bores;

a first plurality of holes operatively arranged to attach the locking cover to the variable camshaft phaser using a plurality of bolts;

a rear surface including a locking pin channel;

a radially inward facing surface including a recess extending radially outward therefrom; and, a radially outward facing surface; and, an oil reservoir cover secured to the front surface of the locking cover.

17. The oil reservoir as recited in claim 16, wherein the locking cover further comprises a plurality of counter-bores, and each of the first plurality of holes comprises one of the plurality of counter-bores.

18. The oil reservoir as recited in claim 17, wherein the oil reservoir cover comprises a plurality of depressions extending in a first axial direction, the plurality of depressions operatively arranged to engage the plurality of counter-bores.

19. The oil reservoir as recited in claim 18, wherein the oil reservoir cover further comprises a second plurality of holes operatively arranged to align with the first plurality of holes and attach the oil reservoir cover to the variable camshaft phaser via the plurality of bolts.

20. The oil reservoir as recited in claim 19, wherein the oil reservoir cover comprises a frusto-conical surface extending in a second axial direction, opposite the first axial direction.

* * * * *